US006266988B1

(12) United States Patent
Kimura et al.

(10) Patent No.: US 6,266,988 B1
(45) Date of Patent: Jul. 31, 2001

(54) CROSS ROLLING MACHINE

(75) Inventors: Shinsaku Kimura; Kanji Hayashi; Tadashi Nakagawa, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/454,104

(22) Filed: Dec. 3, 1999

(30) Foreign Application Priority Data

Dec. 4, 1998 (JP) ..... 10-345405

(51) Int. Cl.[7] ..... B21B 31/16
(52) U.S. Cl. ..... 72/237; 72/241.4
(58) Field of Search ..... 72/241.2, 245, 72/241.4, 237

(56) References Cited

U.S. PATENT DOCUMENTS

| | | | | |
|---|---|---|---|---|
| 1,860,931 | * | 5/1932 | Keller | 72/245 |
| 4,727,741 | * | 3/1988 | Ushifusa et al. | 72/245 |
| 5,142,892 | * | 9/1992 | Noe et al. | 72/245 |
| 5,390,518 | * | 2/1995 | Morimoto et al. | 72/366.2 |

FOREIGN PATENT DOCUMENTS

| | | | | |
|---|---|---|---|---|
| 2 195 279 | | 4/1988 | (GB) . | |
| 5-237511 | * | 9/1993 | (JP) | 72/241.2 |

OTHER PUBLICATIONS

Patent Abstracts of Japan, vol. 007, No. 041 (m–194), Feb. 18, 1983 & JP 57 190712 A (Mitsubishi Jukogyo KK: Others: 01), Nov. 24, 1982.

Patent Abstracts of Japan, vol. 009, No. 264 (M–423), Oct. 23, 1985 & JP 60 111702 A (Mitsubishi Jukogyo KK), Jun. 18, 1985.

Patent Abstracts of Japan, vol. 003, No. 079, (C–051), Jul. 6, 1979 & JP 54 054949 A (Ishikawajima Harima Heavy Ind Co Ltd), May 1, 1979.

* cited by examiner

*Primary Examiner*—Lowell A. Larson
(74) *Attorney, Agent, or Firm*—Alston & Bird LLP

(57) ABSTRACT

An object of the present invention is to provide a cross rolling machine in which the simplification of a drive system and the improved rigidity of a housing are achieved, the accuracy of crossing operation is enhanced, and the economical efficiency is high. To achieve the above object, a pair of top work roll chock 22 and top backup roll chock 44 are fixed by operating hydraulic cylinders 243 and 443 on the delivery side in synchronism to move pressing members 241 and 441 in the direction of delivery side to the position for positioning and by moving pressing members 231 and 431 on the entrance side in the direction of delivery side by hydraulic cylinders 233 and 433 on the entrance side to press the chocks 22 and 42 on the pressing members 241 and 441 on the delivery side. A pair of bottom work roll chock 32 and bottom backup chock 52 are positioned on the entrance side and fixed by operating hydraulic cylinders 333, 533, 343 and 543 in the opposite direction (entrance direction). Thus, the top pair and the bottom pair are pair crossed.

8 Claims, 5 Drawing Sheets

CROSS ROLLING MACHINE

FIELD OF THE INVENTION AND RELATED ART STATEMENT

The present invention relates to a cross rolling machine for rolling a metal sheet by using a pair of work roll and backup roll on the top side and a pair of work roll and backup roll on the bottom side which are crossed each other.

As one means effective in controlling a sheet crown produced when a metal sheet is rolled, a cross rolling method relating to the present invention has been widely used. As one example of this cross rolling method, for example, as shown in FIGS. 3 and 4, a metal sheet 1001 is rolled to a predetermined thickness in a state in which work rolls 1002 and 1003 and backup rolls 1004 and 1005 are arranged vertically in the opposite sides of the metal sheet 1001, and a pair of the work roll 1002 and the backup roll 1004 on the top side and a pair of the work roll 1003 and the backup roll 1005 on the bottom side are pair crossed each other.

Driving means for crossing the work rolls 1002 and 1003 and the backup rolls 1004 and 1005 in pairs will be described with reference to FIG. 5. The work rolls 1002 and 1003 and the backup rolls 1004 and 1005 are arranged vertically in a housing 1006 of a rolling machine, and the metal sheet 1001 is rolled in the direction of arrow mark A (in the left-to-right direction in FIG. 5) from the entrance side to the delivery side.

On the rolling machine of this type, first, the pair of the work roll 1002 and the backup roll 1004 on the top side are pair crossed as follows: When the rotation of a motor (not shown) is transmitted from universal joints on the entrance and delivery sides on the top side to worm reduction gears 1016, 1016 via connecting shafts 1017, 1017, screw rods 1015, 1015 threadedly engaging with fixing nuts advance (entrance side) or retreat (delivery side) while being rotated, by which a work roll chock 1007 and a backup roll chock 1009 are pressed and moved in the direction from entrance side to delivery side at the same time via crossheads 1011 and sliding members 1012. The crosshead 1011 is advanced by being pushed out by the screw rod 1015, and retreated by being pulled back by a hydraulic cylinder 1018.

Then, the pair of the work roll 1003 and the backup roll 1005 on the bottom side are pair crossed as follows: By rotating another motor (not shown) in the direction opposite to the motor for the top side, the connecting shafts 1017, worm reduction gears 1016, screw rods 1015, crossheads 1011, and other elements are operated in the direction opposite to the elements on the top side, by which a work roll chock 1008 and a backup roll chock 1010 are pushed out from the delivery side to the entrance side at the same time.

For a housing 1006' (not shown) on the opposite side, pair crossing is effected in the same manner as described above. Although the pair of the work roll 1002 and the backup roll 1004 on the top side and the pair of the work roll 1003 and the backup roll 1005 on the bottom side are crossed in this manner, this driving means requires a large number of operating members ranging from the motor to the crosshead and a complicated drive system. Also, the housing 1006, which is formed with a groove for the crosshead, has low rigidity.

Next, another four-high pair cross rolling machine will be described with reference to FIG. 6. By operating hydraulic cylinders 1019, 1019 on the entrance and delivery sides in synchronism with each other, a work roll chock 1007 (1008) and a backup roll chock 1009 (1010) are pair crossed via crossheads 1011 and sliding members 1012. Although, in this example, the use of the hydraulic cylinders in the drive system simplifies the operating members and drive system, it is difficult to uniformly transmit the pressing force from the hydraulic cylinders 1019, 1019 on the entrance and delivery sides from the crosshead 1011 to the work roll chock 1007 (1008) and the backup roll chock 1009 (1010). Also, the housing 1006 has low rigidity because it is formed with a groove for the crosshead.

OBJECT AND SUMMARY OF THE INVENTION

The present invention has been made to solve the above problems, and accordingly an object thereof is to provide a cross rolling machine in which crossheads are disused, and work roll chocks and backup roll chocks are pressed directly by hydraulic cylinders, by which a complicated drive system is simplified and the number of components is reduced, the rigidity of a housing is increased, the accuracy of crossing operation is enhanced, and the economical efficiency is improved.

To achieve the above object, the present invention provides a cross rolling machine which rolls a metal sheet to a predetermined thickness in a state in which work rolls and backup rolls are arranged vertically on the opposite sides of the metal sheet, and a pair of the work roll and the backup roll on the top side and a pair of the work roll and the backup roll on the bottom side are pair crossed each other, characterized in that hydraulic cylinders engaging with the work roll chock are disposed in one set on the entrance and delivery sides each of the rolling machine, and hydraulic cylinders engaging with the backup roll chock are disposed in one set on the entrance side of the rolling machine and in two sets on the delivery side thereof.

The term "pair cross" used herein means that either or both of the top pair and the bottom pair are turned in a horizontal plane, by which the pairs are crossed each other at a predetermined angle (predetermined cross angle).

Contrary to this, the hydraulic cylinders engaging with the backup roll chock may be disposed in two sets on the entrance side of the rolling machine and in one set on the delivery side thereof.

Also, the backup roll chock may be moved to a position for positioning at a predetermined cross angle by the two sets of hydraulic cylinders disposed on the entrance or delivery side of the rolling machine, and may be pressed and fixed by the one set of hydraulic cylinder disposed on the entrance or delivery side on the other side.

Also, the configuration may be such that when the backup roll chock is moved to the position for positioning, the second hydraulic cylinders engaging with the backup roll chock are operated in synchronism with the first hydraulic cylinder engaging with the chock for the work roll paired with the backup roll.

Also, the configuration may be such that screws are disposed in place of the hydraulic cylinders for performing the positioning at the predetermined cross angle, and the positioning at the predetermined cross angle is performed by turning the screws. That is to say, the top paired chocks are moved to the position for positioning at the same time, and the bottom paired chocks are moved to the position for positioning at the same time.

The cross rolling machine in accordance with the present invention, which rolls a metal sheet to a predetermined thickness in a state in which work rolls and backup rolls are arranged vertically on the opposite sides of the metal sheet, and a pair of the work roll and the backup roll on the top side and a pair of the work roll and the backup roll on the bottom side are pair crossed each other, is also characterized in that hydraulic cylinders engaging with work roll chock are disposed in one set on the entrance and delivery sides each of the rolling machine, and hydraulic cylinders engaging with backup roll chock are disposed in two sets on the entrance and delivery sides each of the rolling machine.

The backup roll chock may be moved to a position for positioning at a predetermined cross angle by the two sets of hydraulic cylinders disposed on the entrance or delivery side of the rolling machine, and may be pressed and fixed by the two sets of hydraulic cylinders disposed on the entrance or delivery side on the other side.

Also, the configuration may be such that when the backup roll chock is moved to the position for positioning, the second hydraulic cylinders engaging with the backup roll chock are operated in synchronism with the first hydraulic cylinder engaging with the chock for the work roll paired with the backup roll. That is to say, the top paired chocks are moved to the position for positioning at the same time, and the bottom paired chocks are moved to the position for positioning at the same time.

Also, the configuration may be such that screws are disposed in place of the hydraulic cylinders for performing the positioning at the predetermined cross angle, and the positioning at the predetermined cross angle is performed by turning the screws.

As seen from the above description, the present invention achieves excellent effects as described below.

The cross rolling machine in accordance with the present invention, which rolls a metal sheet to a predetermined thickness in a state in which work rolls and backup rolls are arranged vertically on the opposite sides of the metal sheet, and a pair of the work roll and the backup roll on the top side and a pair of the work roll and the backup roll on the bottom side are pair crossed each other, is characterized in that first liquid-operated cylinders engaging with top and bottom work roll chocks and second liquid-operated cylinders engaging with top and bottom backup roll chocks are disposed on the entrance and delivery sides of the metal sheet. Therefore, the drive system can be simplified and the number of components can be reduced, and the economical efficiency can be improved.

Also, the cross rolling machine in accordance with the present invention is characterized in that first hydraulic cylinders engaging with top and bottom work roll chocks are disposed in one set on the entrance and delivery sides each of the metal sheet, and second hydraulic cylinders engaging with top and bottom backup roll chocks are disposed in two sets on one side and in one set on the other side of the entrance and delivery sides of the metal sheet. Therefore, the drive system can be simplified and the number of components can be reduced, the economical efficiency can be improved, and also the strength of the machine can be increased. Further, since two sets of hydraulic cylinders are disposed on one side and one set thereof on the other side, the tilting and falling-down of the backup roll chock can be prevented.

If configuration is such that the backup roll chock is moved to a position for positioning at a predetermined cross angle by the two sets of hydraulic cylinders disposed on one side of the second hydraulic cylinders, and is pressed and fixed by the one set of hydraulic cylinder disposed on the other side, since the positioning and fixing are performed by the hydraulic cylinders, the components can further be simplified, the work efficiency for the pair crossing operation can be increased, and the time taken for pair crossing at the predetermined cross angle can be shortened.

Also, the cross rolling machine in accordance with the present invention is characterized in that first hydraulic cylinders engaging with top and bottom work roll chocks are disposed in one set on the entrance and delivery sides each of the metal sheet, and second hydraulic cylinders engaging with top and bottom backup roll chocks are disposed in two sets on the entrance and delivery sides each of the metal sheet. Therefore, the drive system can be simplified and the number of components can be reduced, the economical efficiency can be improved, and the strength of the machine can be increased. Also, even if the reduction load is high, the backup roll chock can be supported securely from both sides, so that the tilting and falling-down of the backup roll chock can be prevented.

If the configuration is such that the backup roll chock is moved to a position for positioning at a predetermined cross angle by the two sets of hydraulic cylinders disposed on one side of the second hydraulic cylinders, and is pressed and fixed by the two sets of hydraulic cylinder disposed on the other side, since the positioning and fixing are performed by the hydraulic cylinders, the components can further be simplified, the work efficiency for the pair crossing operation can be increased, and the time taken for pair crossing at the predetermined cross angle can be shortened.

If the configuration is such that when the backup roll chock is moved to the position for positioning, the second hydraulic cylinders engaging with the backup roll chock are operated in synchronism with the first hydraulic cylinder engaging with the chock for the work roll paired with the backup roll, the positioning operation can be performed smoothly, and the time taken for pair crossing can further be shortened.

If the configuration is such that screws are disposed in place of the second hydraulic cylinders for moving the backup roll chock to the position for positioning, and the backup roll chock is moved to the position for positioning at the predetermined cross angle by turning the screws, the accuracy of positioning can be enhanced, the whole system can further be simplified, and the economical efficiency can further be improved.

DETAILED DESCRIPTION OF PREFERRED EMBODIMENTS

Embodiments of a cross rolling machine in accordance with the present invention will be described in detail with reference to the accompanying drawings.

Figure 1:
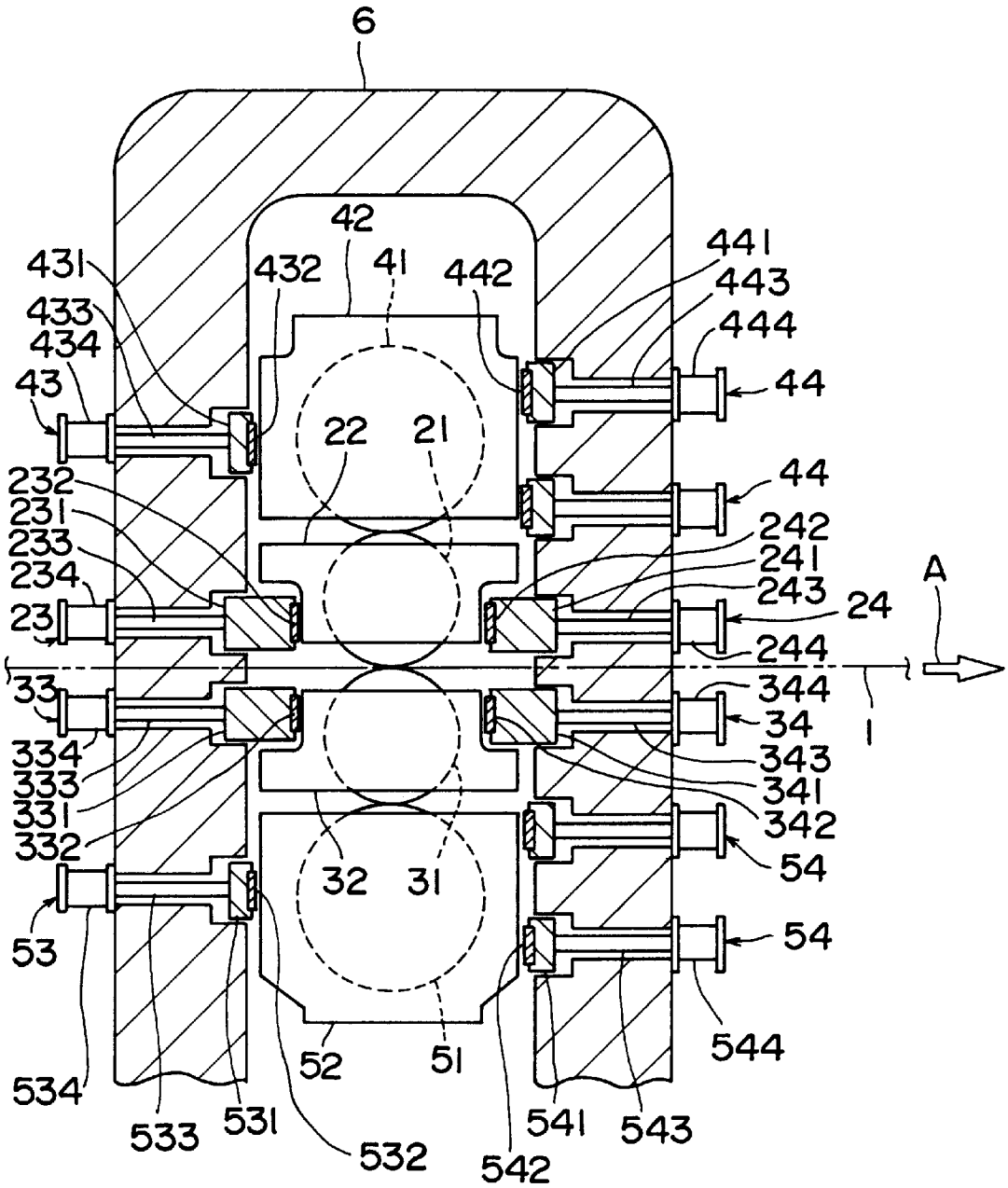
FIG. 1 is a sectional view of a principal portion of a cross rolling machine in accordance with a first embodiment of the present invention.

In a first embodiment, as shown in FIG. 1, in a housing 6 of a rolling machine, a top work roll 21 and a top backup roll 41 are arranged on the top side of a metal sheet 1 being rolled, and a bottom work roll 31 and a bottom backup roll 51 are arranged on the bottom side of the metal sheet 1. The opposite ends of the top work roll 21 are rotatably held by top work roll chocks 22, those of the top backup roll 41 by top backup roll chocks 42, those of the bottom work roll 31 by bottom work roll chocks 32, and those of the bottom backup roll 51 by bottom backup roll chocks 52. The metal sheet 1 moves in the left-to-right direction in FIG. 1, thereby being rolled by the top work roll 21 and the bottom work roll 31. The top work roll 21 has a diameter smaller than that of the top backup roll 41, and the bottom work roll 31 has a diameter smaller than that of the bottom backup roll 51.

On the entrance side (left side in FIG. 1) of the top work roll chock 22, a set of cross drive member 23 is disposed, and on the delivery side (right side in FIG. 1) thereof, a set of cross drive member 24 is disposed. On the entrance side of the bottom work roll chock 32, a set of cross drive member 33 is disposed, and on the delivery side thereof, a set of cross drive member 34 is disposed. Also, on the entrance side of the top backup roll chock 42, a set of cross drive member 43 is disposed, and on the delivery side thereof, two sets of cross drive members 44 are disposed. On the entrance side of the bottom backup roll chock 52, a set of cross drive member 53 is disposed, and on the delivery side thereof, two sets of cross drive members 54 are disposed.

The cross drive members 23, 24, 33, 34, 43, 44, 53 and 54 have the same basic configuration, each being provided with a sliding member, a pressing member, a piston rod, and a hydraulic cylinder. Specifically the cross drive member 23 is provided with a pressing member 231, a sliding member 232, a piston rod 233, and a hydraulic cylinder 234, and the cross drive member 24 is provided with a pressing member 241, a sliding member 242, a piston rod 243, and a hydraulic cylinder 244. The cross drive member 33 is provided with a pressing member 331, a sliding member 332, a piston rod 333, and a hydraulic cylinder 334, and the cross drive member 34 is provided with a pressing member 341, a sliding member 342, a piston rod 343, and a hydraulic cylinder 344. The cross drive member 43 is provided with a pressing member 431, a sliding member 432, a piston rod 433, and a hydraulic cylinder 434, and the cross drive member 44 is provided with a pressing member 441, a sliding member 442, a piston rod 443, and a hydraulic cylinder 444. The cross drive member 53 is provided with a pressing member 531, a sliding member 532, a piston rod 533, and a hydraulic cylinder 534, and the cross drive member 54 is provided with a pressing member 541, a sliding member 542, a piston rod 543, and a hydraulic cylinder 544.

The following is a description of the sliding member, pressing member, piston rod, and hydraulic cylinder which constitute the cross drive member. Since these elements are basically common among the cross drive members, the following explanation is given of the cross drive member 23 as a typical example for the convenience of explanation.

The body of the hydraulic cylinder 234 is attached to the housing 6, and the piston rod 233 is mounted in such a manner as to project and retract. The pressing member 231, which transmits the pressing force from the hydraulic cylinder 234 to the top work roll chock 22, is fixed to the distal end of the piston rod 233. The sliding member 232, which is made of a material easy to slide at the time of vertical movement, is fixed to the outside (opposite side to a face to which the piston rod 233 is fixed) of the pressing member 231.

The hydraulic cylinder 234 is connected to control means (not shown). This control means carries out speed control, direction control, and pressure control of the piston rod 233. As the control means, various control circuits commonly used may be used.

The following is a description of the pair crossing operation of the rolls 21, 31, 41 and 51.

For the top work roll 21 and the top backup roll 41, the hydraulic cylinder 244 and the hydraulic cylinders 444, 444 on the delivery side are operated in synchronism to move the pressing members 241, and 441, 441 on the delivery side in the direction of delivery side to a position where a predetermined cross angle is obtained, by which the pressing members 241 and 441, 441 on the delivery side are positioned. At the same time, the hydraulic cylinder 234 and the hydraulic cylinder 434 on the entrance side are operated to move the pressing members 231 and 431 on the entrance side in the direction of delivery side, by which the top work roll chock 22 and the top backup roll chock 42 are pressed on the pressing members 241 and 441, 441 on the delivery side, respectively. Thus, the top work roll chock 22 and the top backup roll chock 42 are fixed at the predetermined cross angle. Specifically, the positions are set by the pressing members 241 and 441, 441 on the delivery side, and the top work roll chock 22 and the top backup roll chock 42 are moved to the set positions and pressed by the pressing members 231 and 431 on the entrance side, respectively, by which the chocks 22 and 42 are fixed.

The pair of the bottom work roll 31 and the bottom backup roll 51 are moved in the direction (direction of entrance side) opposite to the direction in which the top pair moves (direction of delivery side). The hydraulic cylinder 344 and the hydraulic cylinders 544, 544 on the delivery side are operated in synchronism to move the pressing members 341 and 541, 541 on the delivery side in the direction of entrance side to a position where the predetermined cross angle is obtained, by which the pressing members 341 and 541, 541 on the delivery side are positioned. As a result of this movement, the bottom work roll chock 32 and the bottom backup roll chock 52 are also positioned. At the same time, the hydraulic cylinder 334 and the hydraulic cylinder 534 on the entrance side are operated so that the pressure acts in the direction of delivery side. Therefore, the pressing members 331 and 531 on the entrance side press the bottom work roll chock 32 and the bottom backup roll chock 52, respectively, in the direction of delivery side, and thereby the chocks 32 and 52 are fixed at the predetermined cross angle. That is to say, the bottom work roll chock 32 and the bottom backup roll chock 52 are moved to the set position by the pressing members 341 and 541, 541 on the delivery side, and are pressed and fixed by the pressing members 331 and 531 on the entrance side.

The above description has been of the housing 6 on one side, and the operation is performed in the same way for a housing 6' on the other side.

Thus, by operating the hydraulic cylinders on both sides of the housing 6 and the housing 6', the pair of the top work roll 21 and the top backup roll 41 and the pair of the bottom work roll 31 and the bottom backup roll 51 are pair crossed each other.

If each of the chocks is moved vertically (in the direction of top and bottom in FIG. 1) by a reduction load or the like during the operation of the rolling machine, the chock slides with respect to the side face of each of the sliding members. Specifically, when the top work roll chock 22 and the top backup roll chock 42 are moved vertically, the sliding members 232 and 242 slide on the side faces of the top work roll chock 22, and the sliding members 432 and 442, 442 slide on the side faces of the top backup roll chock 42. When the bottom work roll chock 32 and the bottom backup roll chock 52 are moved vertically, the sliding members 332 and 342 slide on the side faces of the bottom work roll chock 32, and the sliding members 532 and 542, 542 slide on the side faces of the bottom backup roll chock 52. Therefore, the rolls 21, 31, 41 and 51 can be moved vertically while the predetermined cross angle is kept.

Thus, since the hydraulic cylinders 434 and 444, 444 engaging with the top backup roll chock 42 and the hydraulic cylinders 534 and 544, 544 engaging with the bottom backup roll chock 52 are disposed in one set on the entrance side and in two sets on the delivery side, the tilting and falling-down of the chocks 42 and 52 occurring at the time of cross movement and fixation can be prevented.

Although one set of hydraulic cylinder is disposed on the entrance side, and two sets of hydraulic cylinders are disposed on the delivery side in this embodiment, contrary to this, two sets of hydraulic cylinders may be disposed on the entrance side, and one set of hydraulic cylinder may be disposed on the delivery side, and the positioning may be performed by the two sets of hydraulic cylinders on the entrance side. This configuration achieves the same operation and effects.

As described above, in this embodiment, one hydraulic cylinder is disposed on the entrance side of the backup roll chock, and the pressing force from each of the hydraulic cylinders is applied directly to the chock so that the work rolls and the backup rolls are moved so as to be crossed each other in pairs. Therefore, in this embodiment, the conventionally used crosshead is disused, and the work roll chock and the backup roll chock are pressed directly by the hydraulic cylinders, so that the drive system can be simplified and the number of components can be reduced as compared with the conventional cross rolling machine, whereby the economical efficiency of the rolling machine can be improved. Also, the absence of a groove for crosshead increases the rigidity of housing, thereby improving the structural strength of the rolling machine. Further, since the hydraulic cylinders engaging with the backup roll chock are disposed in one set on one side and in two sets on the other side, the tilting and falling-down of the chock can be prevented.

Figure 2:
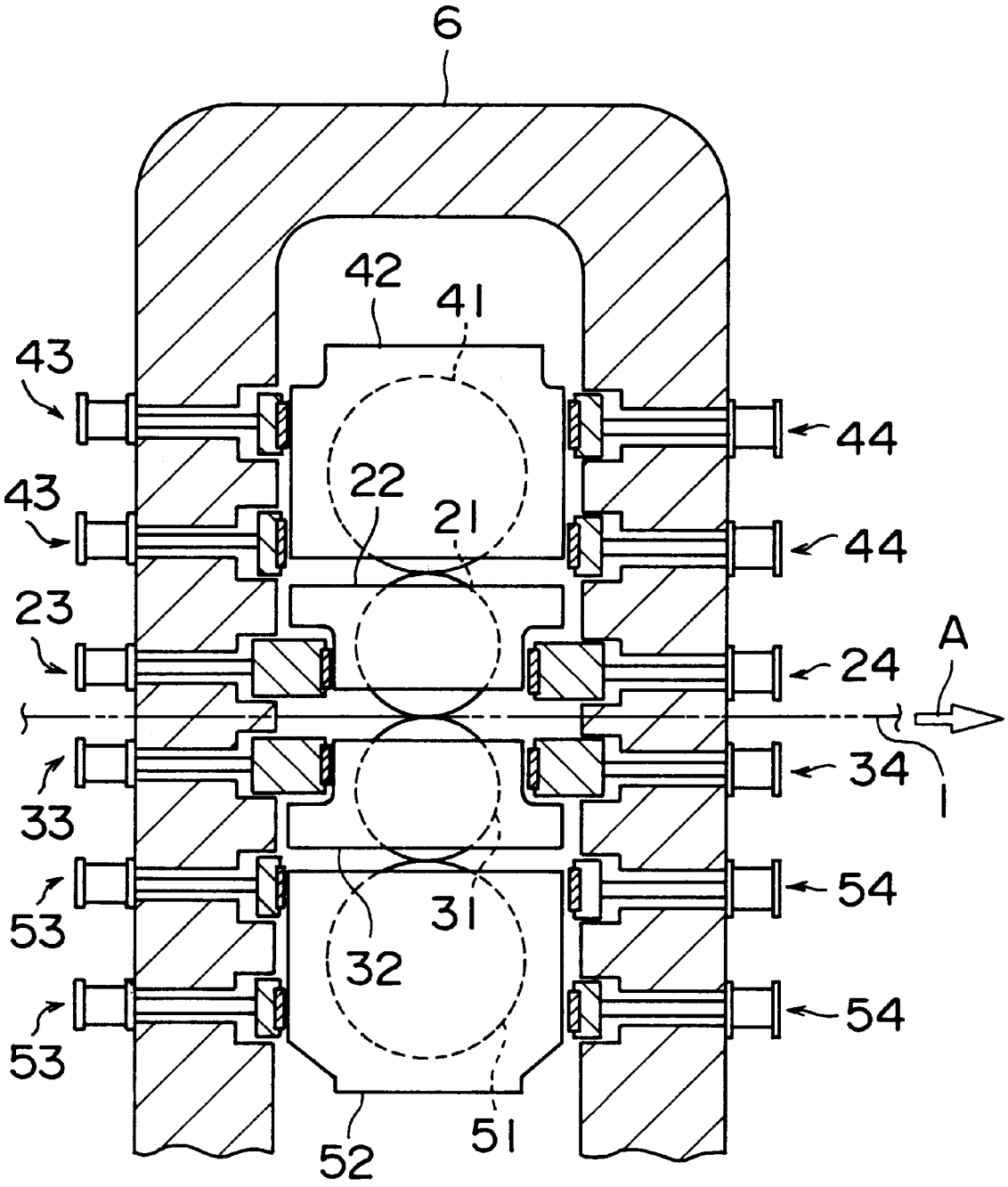
FIG. 2 is a sectional view of a principal portion of a cross rolling machine in accordance with a second embodiment of the present invention.
Figure 3:
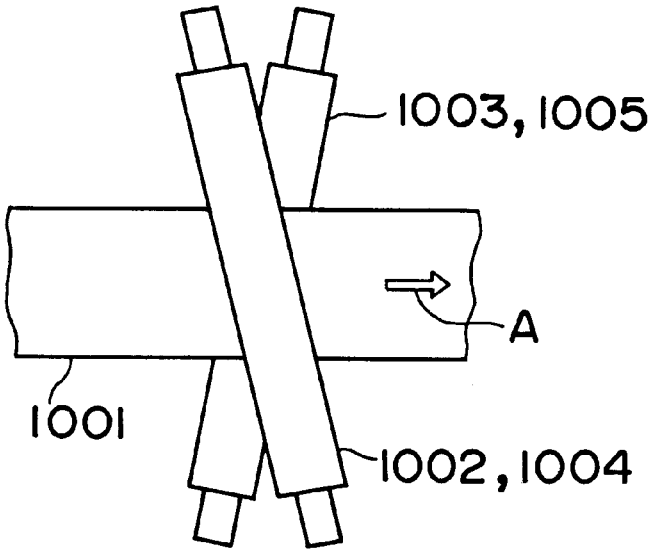
FIG. 3 (RELATED ART)
FIG. 3 is a plan view showing one example of cross rolling relating to the present invention.
Figure 4:
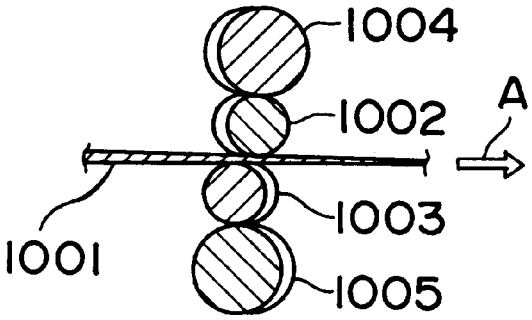
FIG. 4 (RELATED ART)
FIG. 4 is a side sectional view of FIG. 3.
Figure 5:
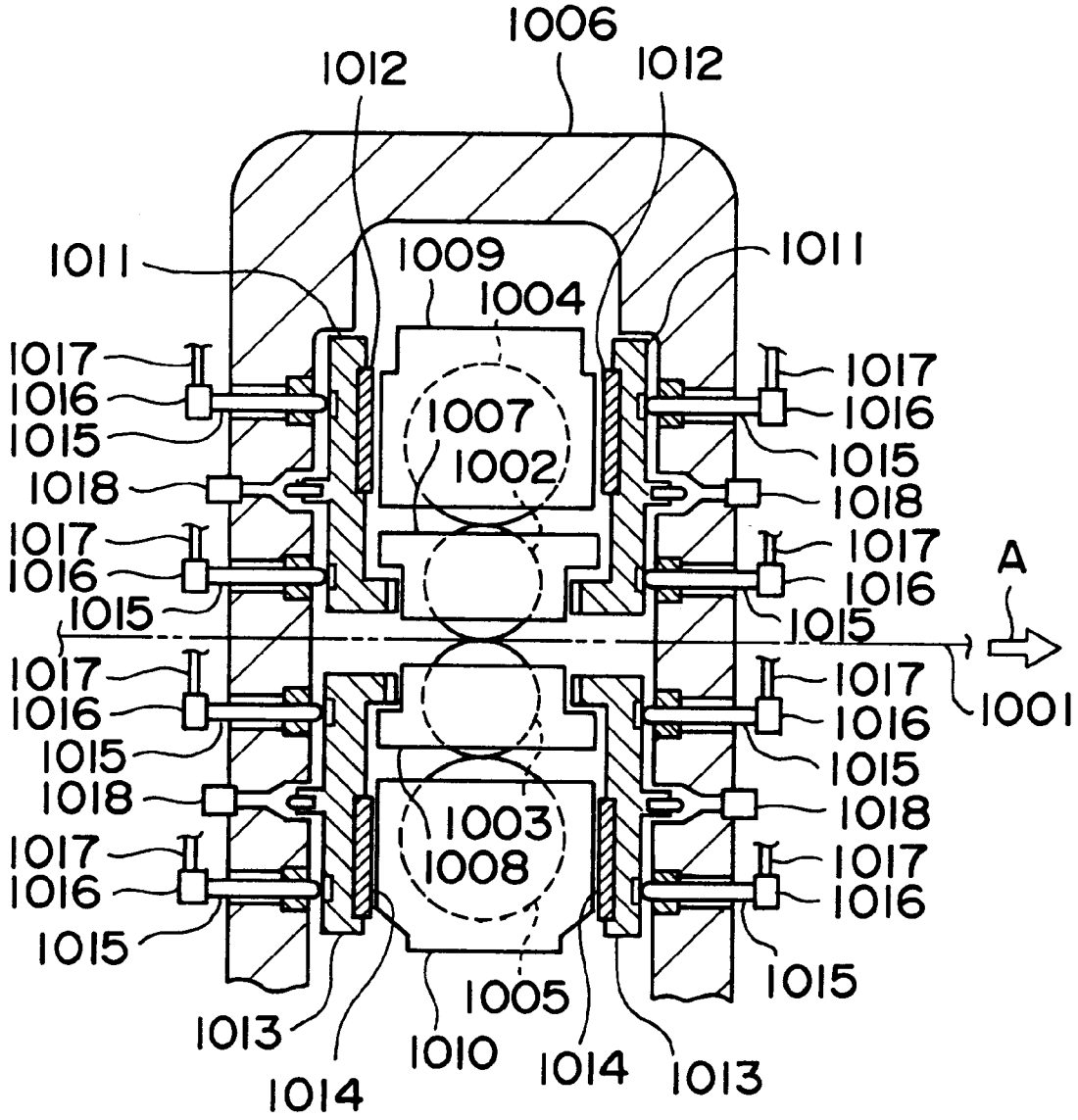
FIG. 5 (RELATED ART)
FIG. 5 is a sectional view of a principal portion of a four-high pair cross rolling machine relating to the present invention.
Figure 6:
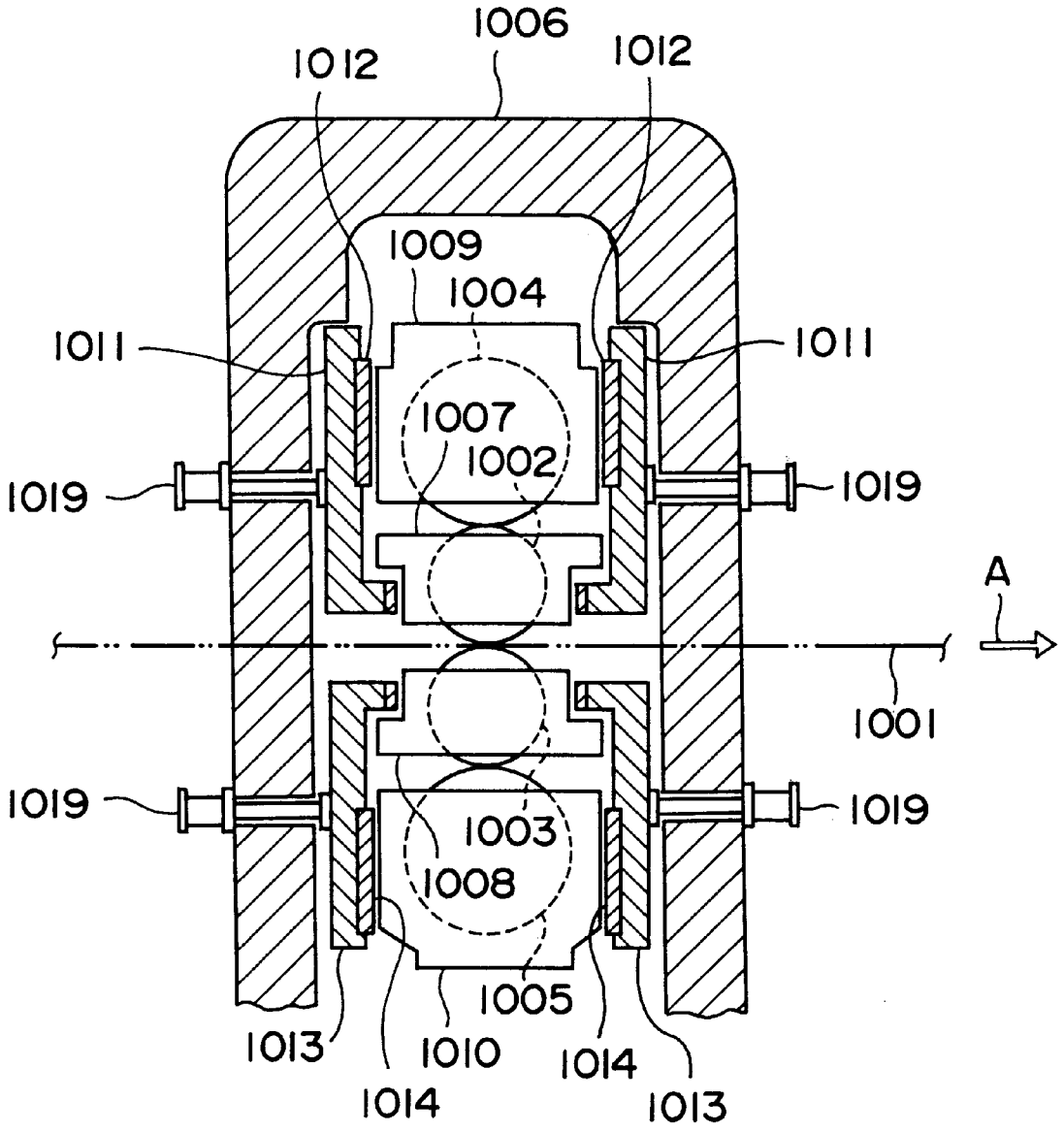
FIG. 6 (RELATED ART)
FIG. 6 is a sectional view of a principal portion of another four-high pair cross rolling machine relating to the present invention.

Next, a second embodiment will be described with reference to FIG. 2. In FIG. 2, the same reference numerals as those in FIG. 1 are applied to the same elements as those of the first embodiment, and the reference numerals of the elements constituting the cross drive member are omitted. Hereafter, the explanation common to that of the first embodiment is omitted.

In this embodiment, another set of cross drive member 43 is added to the entrance side of the top backup roll chock 42 of the first embodiment. Specifically, another set of hydraulic cylinder 434 engaging with the top backup roll chock 42 is provided on the entrance side, and other configurations are the same as those of the first embodiment.

As shown in FIG. 2, the cross drive members 23 and 24 are disposed in one set each on the entrance and delivery sides of the top work roll chock 22, and the cross drive members 33 and 34 are disposed in one set each on the entrance and delivery sides of the bottom work roll chock 32. Also, the cross drive members 43, 43, 44, 44 are disposed in two sets each on the entrance and delivery sides of the top backup roll chock 42, and the cross drive members 53, 53, 54, 54 are disposed in two sets each on the entrance and delivery sides of the bottom backup roll chock 52.

The cross drive members 23, 24, 33, 34, 43, 44, 53 and 54 each comprises the sliding member, pressing member, piston rod, and hydraulic cylinder as in the case of the first embodiment, and also are operated in the same way as in the case of the first embodiment. Thereby, the positioning at a predetermined angle is performed, and the chocks are fixed at the predetermined cross angle by the pressing force.

The following is a description of the pair crossing operation of the rolls 21, 31, 41 and 51.

The two sets, upper and lower, of hydraulic cylinders 444, 444 engaging with the delivery side of the top backup roll chock 42 and the hydraulic cylinder 244 engaging with the delivery side of the top work roll chock 22 are operated in synchronism to move the pressing members 441, 441, and 241 in the direction of delivery side to a position of the predetermined cross angle so that these pressing members are positioned. At the same time, the hydraulic cylinders 434, 434, and 234 on the opposite side (entrance side) are operated to move the pressing members 431, 431, and 231 in the direction of delivery side. By pressing the top backup roll chock 42 and the top work roll chock 22 on the pressing members 441, 441, and 241 on the delivery side, respectively, the top backup roll chock 42 and the top work roll chock 22 are fixed to the positions of the predetermined cross angle.

In order to pair cross the pair of the bottom work roll 31 and the bottom backup roll 51, the operation is performed in the direction opposite to the case of top side. Specifically, the two sets, upper and lower, of hydraulic cylinders 544, 544 engaging with the delivery side of the bottom backup roll chock 52 and the hydraulic cylinder 344 engaging with the delivery side of the bottom work roll chock 32 are operated in synchronism to move the pressing members 541, 541, and 341 in the direction of entrance side to a position of the predetermined cross angle so that these pressing members are positioned. At the same time, the hydraulic cylinders 534, 534, and 334 on the opposite side (entrance side) are operated to move the pressing members 531, 531, and 331 in the direction of delivery side. By pressing the bottom backup roll chock 52 and the bottom work roll chock 32 on the pressing members 541, 541, and 341 on the delivery side, respectively, the bottom backup roll chock 52 and the bottom work roll chock 32 are fixed to the positions of the predetermined cross angle.

As described above, the hydraulic cylinders 434 and 444 engaging with the top backup roll chock 42 and the hydraulic cylinders 534 and 544 engaging with the bottom backup roll chock 52 are disposed in two sets on the entrance side and in two sets on the delivery side. Therefore, even when the reduction load is high, the top backup roll chock 42 and the bottom backup roll chock 52 can be supported securely from both sides, so that the tilting and falling-down of the top backup roll chock 42 and the bottom backup roll chock 52 can be prevented.

As described above, according to this embodiment, even if the reduction load is high as compared with the case of the first embodiment, the top backup roll chock 42 and the bottom backup roll chock 52 can be supported securely from both sides, so that the tilting and falling-down of the top backup roll chock 42 and the bottom backup roll chock 52 can be prevented.

As a modification of the first or second embodiment, a screw may be used in place of the hydraulic cylinder to perform positioning. Specifically, by turning this screw, the positioning at a predetermined angle is performed. This screw acts as a feed screw. By this configuration, the positioning accuracy can be improved, and the components of the machine can be simplified.

Although two sets of cross drive members are disposed for the backup roll chock, the number of cross drive members is not limited to this, and more than two sets of cross drive members may be disposed. In this case, the equal number of cross drive members need not be disposed on the entrance and delivery sides. At least a plurality of sets of cross drive members (hydraulic cylinders) for positioning are disposed.

The hydraulic cylinder may be of a single or double acting type, or may be of a multistage type.

Also, although the hydraulic cylinder is used in the above embodiments, the cylinder is not limited to this type, and a liquid-operated cylinder, which uses a liquid as the working medium, may be used. In this case, for example, water is used as the working medium.

What is claimed is:

1. A cross rolling machine for rolling a metal sheet to a predetermined thickness as the sheet travels from an entrance side to a delivery side thereof, comprising a work roll and a backup roll arranged on a top side of the metal sheet and a work roll and a backup roll arranged on a bottom side of the sheet, and wherein a pair of the work roll and the backup roll on the top side and a pair of the work roll and the backup roll on the bottom side are pair crossed each other, and including top and bottom work roll chocks in which the top and bottom work rolls are respectively retained, and top and bottom backup roll chocks in which the top and bottom backup rolls are respectively retained, and first hydraulic cylinders engaging with the top and bottom work roll chocks and disposed in one set on each of the entrance and delivery sides of the metal sheet, and second hydraulic cylinders engaging with the top and bottom backup roll chocks and disposed in two sets on one of the entrance and delivery sides and in one set on the other of the entrance and delivery sides of the metal sheet.

2. The cross rolling machine according to claim 1, wherein the backup roll chock is moved to a position for positioning at a predetermined cross angle by the two sets of hydraulic cylinders disposed on one side of the second hydraulic cylinders, and is pressed and fixed by the one set of hydraulic cylinder disposed on the other side.

3. The cross rolling machine according to claim 2, wherein when the backup roll chock is moved to the position for positioning, the second hydraulic cylinders engaging with the backup roll chock are operated in synchronism with the first hydraulic cylinder engaging with the chock for the work roll paired with the backup roll.

4. The cross rolling machine according to claim 2, wherein screws are disposed in place of the second hydraulic cylinders for moving the backup roll chock to the position for positioning, and the backup roll chock is moved to the position for positioning at the predetermined cross angle by turning the screws.

5. A cross rolling machine for rolling a metal sheet to a predetermined thickness as the sheet travels from an entrance side to a delivery side thereof, comprising a work roll and a backup roll arranged on a top side of the metal sheet and a work roll and a backup roll arranged on a bottom side of the sheet, and wherein a pair of the work roll and the backup roll on the top side and a pair of the work roll and the backup roll on the bottom side are pair crossed each other, and including top and bottom work roll chocks in which the top and bottom work rolls are respectively retained, and top and bottom backup roll chocks in which the top and bottom backup rolls are respectively retained, and first hydraulic cylinders engaging with the top and bottom work roll chocks and disposed in one set on each of the entrance and delivery sides of the metal sheet, and second hydraulic cylinders engaging with the top and bottom backup roll chocks and disposed in two sets on each of the entrance and delivery sides of the metal sheet.

6. The cross rolling machine according to claim 5, wherein the backup roll chock is moved to a position for positioning at a predetermined cross angle by the sets of hydraulic cylinders disposed on one side of the second hydraulic cylinders, and is pressed and fixed by the two sets of hydraulic cylinders disposed on the other side.

7. The cross rolling machine according to claim 6, wherein when the backup roll chock is moved to the position for positioning, the second hydraulic cylinders engaging with the backup roll chock are operated in synchronism with the first hydraulic cylinder engaging with the chock for the work roll paired with the backup roll.

8. The cross rolling machine according to claim 6, wherein screws are disposed in place of the second hydraulic cylinders for moving the backup roll chock to the position for positioning, and the backup roll chock is moved to the position for positioning at the predetermined cross angle by turning the screws.

* * * * *

UNITED STATES PATENT AND TRADEMARK OFFICE

CERTIFICATE OF CORRECTION

PATENT NO. : 6,266,988 B1
DATED : July 31, 2001
INVENTOR(S) : Kimura et al.

It is certified that error appears in the above-identified patent and that said Letters Patent is hereby corrected as shown below:

Title page,
Item [56], References Cited, OTHER PUBLICATIONS, lines 4 and 5, "Oct. 23, 1985" should read -- Oct. 22, 1985 --.

Column 10,
Line 31, before "sets" insert -- two --.

Signed and Sealed this

Nineteenth Day of March, 2002

*Attest:*

*Attesting Officer*

JAMES E. ROGAN
*Director of the United States Patent and Trademark Office*